US011371806B2

(12) United States Patent
Choiniere

(10) Patent No.: US 11,371,806 B2
(45) Date of Patent: Jun. 28, 2022

(54) MIDBODY CAMERA/SENSOR NAVIGATION AND AUTOMATIC TARGET RECOGNITION

(71) Applicant: BAE SYSTEMS Information and Electronic Systems Integration Inc., Nashua, NH (US)

(72) Inventor: Michael J. Choiniere, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 316 days.

(21) Appl. No.: 16/531,224

(22) Filed: Aug. 5, 2019

(65) Prior Publication Data

US 2021/0055079 A1 Feb. 25, 2021

(51) Int. Cl.
*F41G 7/22* (2006.01)

(52) U.S. Cl.
CPC ..... *F41G 7/2253* (2013.01); *F41G 7/2293* (2013.01)

(58) Field of Classification Search
CPC ..... F41G 7/2253; F41G 7/2293
See application file for complete search history.

(56) References Cited

U.S. PATENT DOCUMENTS 3,924,826 A 9/1975 Reinert
5,379,967 A * 1/1995 Shachar ..... F41G 7/2246 244/3.16
5,529,261 A * 6/1996 Iddan ..... F42B 30/006 244/3.16
5,938,148 A * 8/1999 Orenstein ..... F41G 7/2206 244/3.15
6,007,020 A * 12/1999 Gauggel ..... F41G 7/2226 250/342
7,781,709 B1 * 8/2010 Jones ..... F42B 10/60 102/382
8,354,626 B2 * 1/2013 Eckhardt ..... F41G 7/2293 244/3.1
2001/0013565 A1 * 8/2001 Davidovitch ..... F41G 7/2293 244/3.15

(Continued)

OTHER PUBLICATIONS

International Search Report, PCT/US2020/063762, 8 pages, dated Apr. 20, 2021.

*Primary Examiner* — Marcus E Windrich
(74) *Attorney, Agent, or Firm* — KPIP Law, PLLC; Gary McFaline

(57) ABSTRACT

A guidance assembly and method for guiding an ordnance to a target. The assembly can operated in navigation and targeting modes and has an imager/seeker including an objective lens assembly and an imaging sensor array which provide image data for mapping and terminal seeker performance. The imager/seeker is pivotally mounted on the ordnance. An actuator is coupled to the imager/seeker and can be actuated to pivot the imager/seeker relative to a longitudinal axis of the ordnance from a navigation position to a targeting position. A flight control unit communicates with the imager/seeker and the actuator, and has a processor which analyses the image data to provide navigation flight control signals for guiding the ordnance in the navigation mode of operation and determining a target direction via automatic target recognition or aimpoint algorithms for directing the ordnance to the target in the targeting mode of operation.

14 Claims, 6 Drawing Sheets

(56) References Cited

U.S. PATENT DOCUMENTS

| | | | | |
|---|---|---|---|---|
| 2007/0205320 | A1* | 9/2007 | Zemany | F41G 7/2293 244/3.1 |
| 2012/0312912 | A1* | 12/2012 | Murphy | F41G 7/007 398/130 |
| 2014/0172200 | A1* | 6/2014 | Miralles | F41G 7/2286 701/3 |
| 2018/0158198 | A1 | 7/2018 | Kamad | |

* cited by examiner

MIDBODY CAMERA/SENSOR NAVIGATION AND AUTOMATIC TARGET RECOGNITION

FIELD OF THE DISCLOSURE

The present disclosure relates to an assembly and method for navigation and automatic target recognition and more particularly relates to a guidance assembly for an ordnance having a mid-body camera/sensor navigation and automatic target recognition.

BACKGROUND OF THE DISCLOSURE

The use of guidance systems for guiding an ordnance, missile, rocket or other projectile to a target is known. It is common in guiding an ordnance to a target to divide the flight of the ordnance from launch to impact into a navigation phase and a targeting phase. Guidance and control of the ordnance during each of these phases of flight is based on the knowledge of different data, information and/or parameters. The navigation phase of flight, follows the launch of the ordnance and corresponds to a period during which the ordnance is flown generally like an airplane. During the navigation phase of flight, it is necessary to know the attitude or rather the orientation of the ordnance relative to the earth, i.e., up and down, left and right. To determine the attitude of the ordnance, the ordnance typically includes a first "camera" including an objective lens assembly and sensor array that is fixed to the ordnance such that its Field Of View (FOV) is generally directed laterally in relation to the longitudinal axis of the ordnance, i.e., perpendicular to the ordnance. The sensor array of the first camera acquires sensor readings that are specific for navigation. From these sensor readings of the first camera as well as data of other sensors and/or components, the guidance system uses one set of algorithms to determine the attitude of the ordnance and then control its flight until the ordnance approaches the target, meaning until the ordnance is within a certain distance from the target at which the target can be recognized. At this point of flight, the ordnance transitions from the navigation phase to the targeting phase of flight in which the ordnance is guided to termination. Due to the proximity of the ordnance with respect to the target, in the targeting phase of flight, the trajectory of the ordnance is at least substantially aligned with the target, i.e., the target is generally aligned in front of the ordnance, and thus the target cannot be "seen" by the first camera. In other words, the target is not within the FOV of the first camera during the targeting phase of flight. As such, a second "camera", including an objective lens assembly and sensor array, begins collecting readings and information concerning the target and the location of the target. The second camera can form part of an Automatic Target Recognition (ATR) system, and to enhance the reception of target readings and information, the second camera is aligned in a generally forward facing direction, in relation to the direction of flight of the ordnance. In other words, the second camera is directed forward such that the target can be "seen", i.e., is within the FOV of the second camera during the targeting phase of flight. From the readings and information collected by the second camera as well as with the data of further sensors and components, the guidance system can recognize and determine the location of the target and guide the flight of the ordnance based thereon to termination.

To reduce the need for multiple objective lens assemblies and sensor arrays, some guidance systems are known to mount a sensor array and objective lens assembly on the wings of the ordnance at a distance from the ordnance body.

In this case the sensor array and objective lens assembly, due to their position on the wings, provide the guidance system with a large forward facing FOV. Mounting sensor arrays and objective lens assemblies on wings of the ordnance leads to increased costs related to the manufacture of such wings and the increased area within the ordnance when the wings are retracted through corresponding wing slot seals.

The use of two sensor array and objective lens assembly provides the guidance system with a large combined FOV and enables guiding the ordnance from launch to termination. However, due to the twofold sensor arrays and objective lens assemblies, such guidance systems can be expensive to implement on an ordnance and difficult to install in the small amount of installation space available such an ordnance.

Wherefore it is an object of the present disclosure to overcome the above-mentioned shortcomings and drawbacks associated with the conventional guidance systems having one sensor array and objective lens assembly for guidance during the navigation phase of flight and another sensor array and objective lens assembly for ATR and guidance during the targeting phase of flight.

SUMMARY OF THE DISCLOSURE

One aspect of the present disclosure is a guidance assembly comprising a camera/sensor (imager/seeker) having a sensor array for detecting electromagnetic radiation (UV, Visible, NIR, SWIR, MWIR or LWIR) and that can be mounted to a body of an ordnance such that the camera/sensor, i.e., the sensor array has a near vertical FOV for performing navigation functions. That is to say in other words that the FOV of the sensor array is directed at least substantially sideways, laterally or perpendicular to the longitudinal axis of the ordnance. The guidance assembly has an actuator that can pivot the sensor array to forward looking position, i.e., having a forward FOW relative to a direction of flight, so as to provide a terminal seeker function. The guidance assembly can further include a window and window seal as well as processing electronics that function to control the flight of the ordnance.

In one embodiment of the disclosed system, the guidance assembly is supported within the ordnance behind the window, which is mounted to the surface of the ordnance, and sealed therein via a window seal to provide protection from weather and/or other environmental conditions. In another embodiment of the system the window is the outer lens surface of the objective lens.

Since the flight profile of the ordnance is lofted, the target is always below the centerline of the ordnance and thus it is not necessity for the guidance system to have a full 360 degree FOV. With this in mind the guidance system according to the disclosure has a FOV of approximately 40 to 50 degrees which reduces the optics of a typical guidance system by up to 75%. In addition, the optics of the guidance system according to the disclosure can pivot and thereby provide the guidance system with a FOV of between 80 to 100 degrees, thus enabling the guidance system to control the flight of the ordnance from launch to termination, i.e., during both the navigation and a targeting phases of flight.

A further aspect of the disclosure is to provide a guidance assembly that can be operated in navigation and targeting modes and has an imager/seeker including an objective lens assembly and an imaging sensor array which can provide image data for mapping and terminal seeker performance. The imager/seeker is pivotally mounted on the ordnance. An actuator is coupled to the imager/seeker and can be actuated to pivot the imager/seeker relative to a longitudinal axis of the ordnance from a navigation position to a targeting position. A flight control unit communicates with the imager/seeker and the actuator, and has a processor which analyses the image data to provide navigation flight control signals for guiding the ordnance in the navigation mode of operation and determining a target direction via automatic target recognition or aimpoint algorithms for directing the ordnance to the target in the targeting mode of operation.

Another aspect of the disclosure is to provide a method of guiding an ordnance with a guidance assembly that operates in a navigation mode and a targeting mode. The method includes providing the ordnance with a guidance assembly having a single imager/seeker that is pivotable depending on an operating mode of the guidance assembly. The imager/seeker is installed in a navigation position within the ordnance. The guidance assembly is operated in the navigation mode for determining, with a flight control unit, an attitude of the ordnance. The flight control unit then controls a trajectory of the ordnance. Then when the guidance assembly switches from operating in the navigation mode to operating in the targeting mode, the imager/seeker is pivoted from the navigation position to a targeting position. The imager/seeker the captures and detects light energy relating to the target. With the flight control unit specific target information is determined which then guides the ordnance to impact with the target.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figures 1, 2:
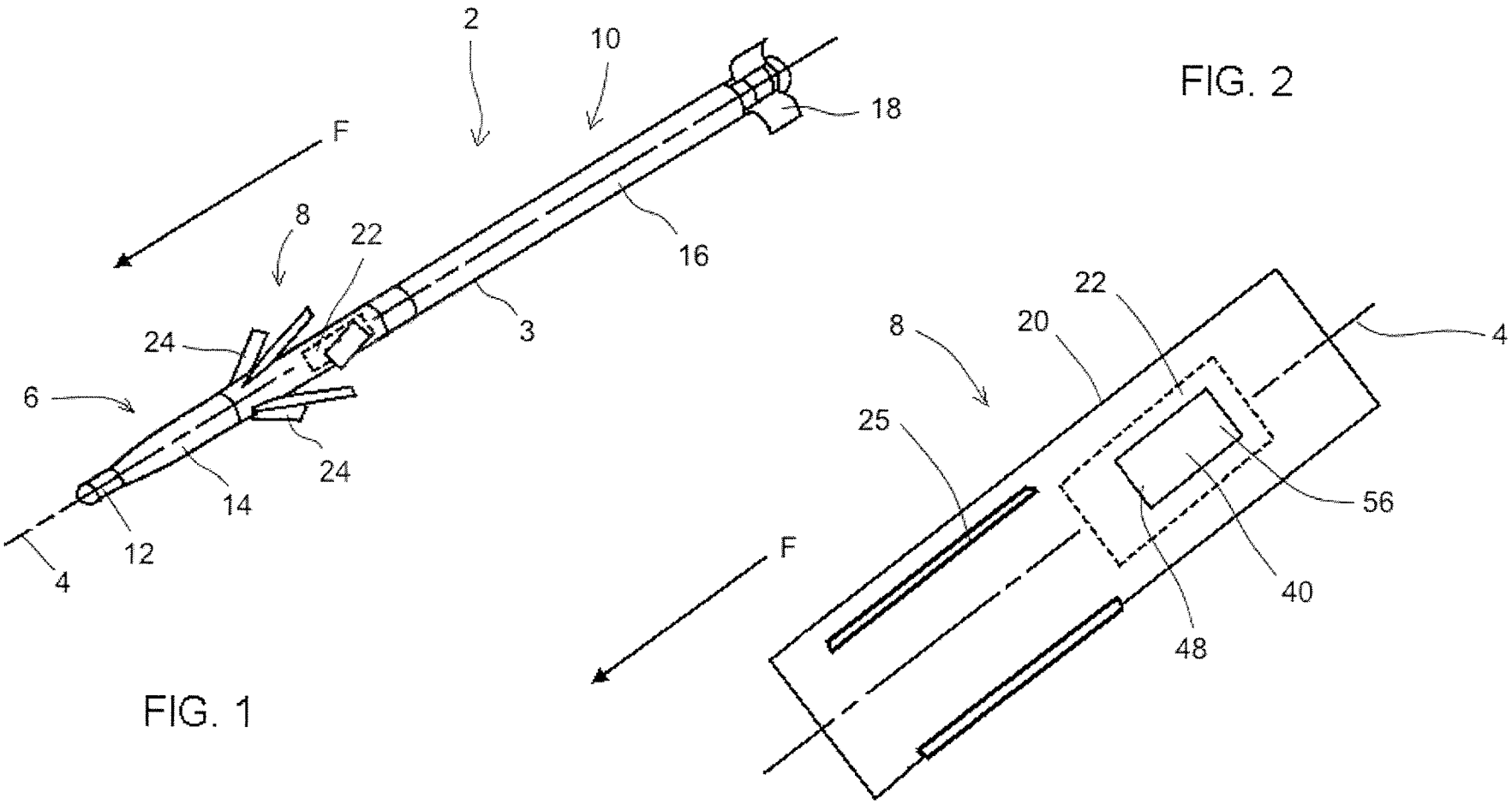
FIG. 1 is a diagrammatic view of an ordnance having a mid-body guidance assembly according to the disclosure.
FIG. 2 is a diagrammatic view of the guidance assembly according to the disclosure with a window panel shown in a closed position.

FIG. 1 diagrammatically illustrates an ordnance, missile, projectile, glider or rocket, e.g., an Advanced Precision Kill (APK) round, and which is hereinafter simply referred to as an ordnance 2. The ordnance 2 has a substantially cylindrical body 30 that defines a longitudinal axis 4 which generally corresponds to the forward direction of flight F of the ordnance 2. The ordnance 2 includes, in relation to its direction of flight F, a leading end 6, a mid-body 8 and a trailing end 10. The leading end 6 of the ordnance 2 is partially in the form of an ogive and can comprise a fuse 12 and warhead 14 while the trailing end 10 of the ordnance 2 comprises a rocket motor 16 and has fins 18 which function to stabilize the ordnance 2 while in flight.

The mid-body 8 of the ordnance 2 has an axially extending cylindrical outer shell 20 which houses or supports a guidance assembly 22 that generally functions to control the flight of the ordnance 2 by adjusting or correcting its trajectory so as to guide the ordnance 2 to a selected target. Although the guidance assembly 22 according to the disclosure is illustrated and described as being supported within the mid-body 8 of the ordnance 2 it is recognized that at least some of the components of the guidance assembly 22 can be arranged in either the leading or trailing ends 6, 10 of the ordnance 2. The guidance assembly 22 can include a plurality wings 24 that are mounted about the circumference of the mid-body 8. Prior to the launching or firing of the ordnance 2, the wings 24 are typically arranged in a stowed position so as to protect them from damage and/or environmental conditions. For example in the stowed position the wings 24 can be wrapped around the mid-body 8 or pivoted into slots 25 (see FIG. 2) in the mid-body 8. Following launch or firing of the ordnance 2, the wings 24 are pivoted to an in-flight position in which the wings 24 extend from the mid-body 8 into the airflow along the ordnance 2. The wings 24 can have air control surfaces, e.g., canards which communicate with the airflow during flight and which are adjustable to so as to control, alter or correct the trajectory of the ordnance 2 in flight.

The guidance assembly 22 further includes an imager/seeker 26 that comprises, for example, one or more of a Semi-Active Laser (SAL) seeker, a Long Wave Infrared (LWIR), Short Wave Infrared (SWIR) imager, or a Radio Frequency (RF) homing seeker. The imager/seeker 26 generally includes an objective lens assembly 28 and a sensor array 30. The objective lens assembly 28 is situated at a head end 29 of the imager/seeker 26 and is configured to capture and focus light energy, e.g., electromagnetic radiation, laser light energy or IR light energy, onto the sensor array 30 which detects the light energy and transmits corresponding sensor signals or rather image data to a flight control unit 32 for mapping and terminal seeker performance. The flight control unit 32 has a processor and data storage element that are connected to a power source and which function to analyze the sensor signals or image data and establish control signals that are used in controlling the flight of the ordnance 2. Mapping and terminal seeker performance as used herein refers to the ability of the imager/seeker 26 to be used by the guidance assembly 22 in both the navigation and targeting phases of flight. The guidance assembly 22 can comprise one or more additional sensor and/or measurement components 33 such as a Global Positioning System (GPS), Inertial Measuring Unit (IMU), a Laser Range Finder (LRF) which can collect and/or measure mapping, navigation, motion, force, range and/or distance readings/data and communicate or rather transmit the readings/data to the flight control unit 32 for analysis and consideration, e.g., determining an attitude of the ordnance 2 and in controlling the flight of the ordnance 2 with the wings/air control surfaces 24. From the readings/data, the flight control unit 32 collects "images" and then based on the altitude of the ordnance 2 scales the collected images and de-warps the images (warping of the images being caused by attitude of the ordnance). Subsequently, the flight control unit 32 compares the collected images to a remote or local data base of images in order to determine the ground position of the ordnance 2.

The guidance assembly 22 according to the disclosure comprises only one objective lens assembly 28 and sensor array 30 which form a single imager/seeker 26 that can be supported in the mid-body 8 in different positions depending on which of the different modes the guidance assembly 22 is operating. As will be discussed in further detail below, during the navigation phase of flight, the guidance assembly 22 operates in a navigation mode in which the ordnance 2 is flown like a plane. In the navigation mode of operation, the imager/seeker 26 is fixed in a sideways facing position. In this position the imager/seeker 26 collects and provides data which is used by the guidance assembly 22 for preforming mapping functions, "mapping performance", i.e., for tracking and guiding the ordnance and determining the attitude or orientation of the ordnance relative to the earth from launch to the transition to the targeting phase of flight. During the targeting phase of flight, the guidance assembly 22 operates in a targeting mode in which target specifics are determined and ordnance 2 is guided to termination. 2 When the guidance assembly 22 is operating in a targeting mode, the imager/seeker 26 is pivoted toward the longitudinal axis to a forward facing position as described below. In this position, the imager/seeker 26 has a FOV, in which the target is located, and collects and provides data to the guidance assembly 22 for terminal seeker performance During terminal seeker performance, the guidance assembly 22 uses ATR or aimpoint algorithms, which analyze data from the imager/seeker 26 as well as other sensor and/or measurement components 33, to detect or distinguish the target within an "image" and then classify and identify the target. The guidance assembly 22 guides the ordnance at the target to termination based on these determinations.

In one embodiment of the guidance assembly 22 according to the disclosure, the imager/seeker 26 comprises a SAL seeker having a see-spot imager which enables the imager/seeker 26 to open to a FOV of between 40 to 50 degrees. The imager/seeker 26 has a central axis 34 which extends from the middle of the objective lens assembly 28 and defines the center of the FOV as illustrated in the figures. The imager/seeker 26 can comprise multiple sensor configurations and provide the imager/seeker 26 with a detection range of up to 6 km and a detection angle of accuracy of 0.1%.

In general the imager/seeker 26 communicates with the flight control unit 32, transmitting sensor signals related to the light energy captured and focused thereon by the objective lens assembly 28. From these sensor signals as well as the readings/data received from the one or more additional sensor and/or measurement components 33, i.e., GPS, IMU, and LRF, the flight control unit 32 can determine the up, down, right and left directions, and specific readings and information concerning the target including the identity, location, and movement of the target such as for ATR purposes. With a single objective lens assembly 28 and sensor array 30, the flight control unit 32 analyses sensor signals and the readings/data from the one or more additional sensors and/or measurement components 33 using ATR or aimpoint algorithms depending on whether the guidance assembly 22 is operating in the navigation mode verses the targeting mode.

Using imagery in the navigation mode, the guidance assembly 22 captures images of the terrain at 1 to 10 Hz, and compares the imagery to a national data base of satellite imagery for example. The comparison starts by scaling the captured image based on altitude (zoom in or out) and attitude (pitch and yaw) of the ordnance relative to the ground. The image based navigation provides GPS like performance depending on the altitude and speed of the ordnance.

Navigation (bearing only) can be accomplished over the open sea by using the waves as reference and maintaining a flight path relative to the direction of the waves.

Figure 4A:
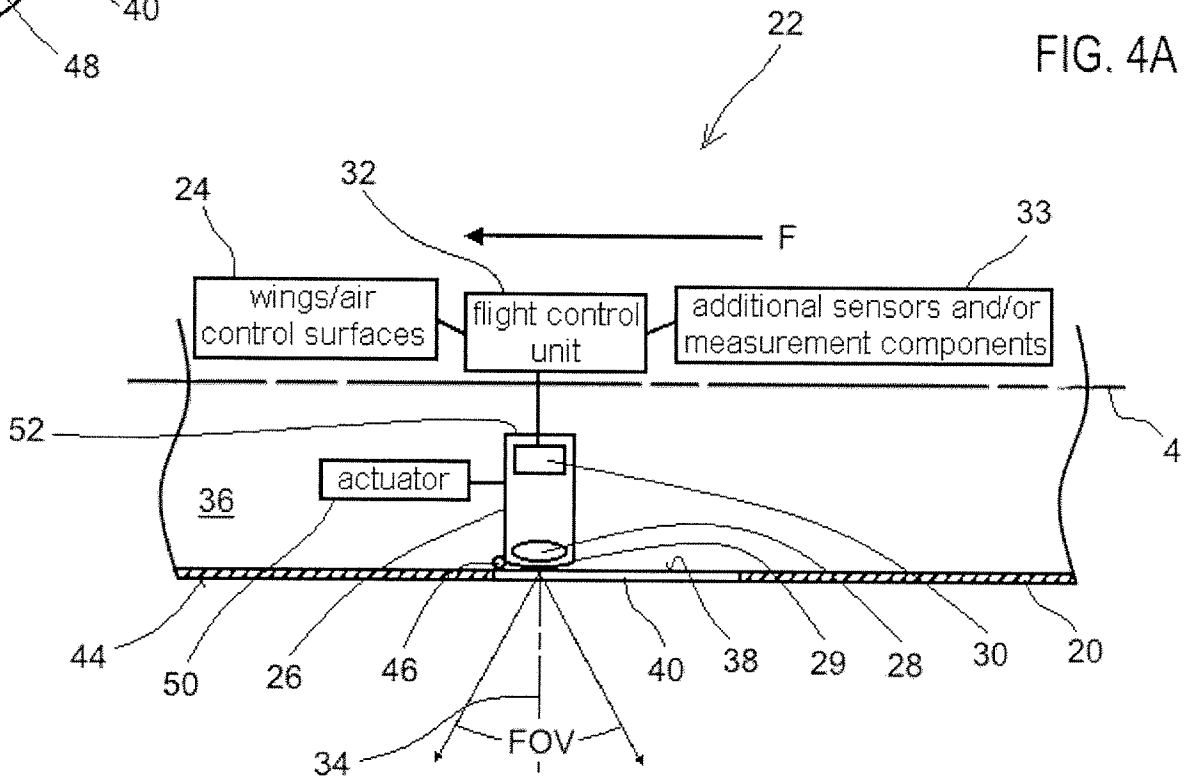
FIG. 4A is a diagrammatic cross-section of a mid-body showing a first embodiment of the guidance assembly with an imager/seeker in a navigation position.
Figure 4B:
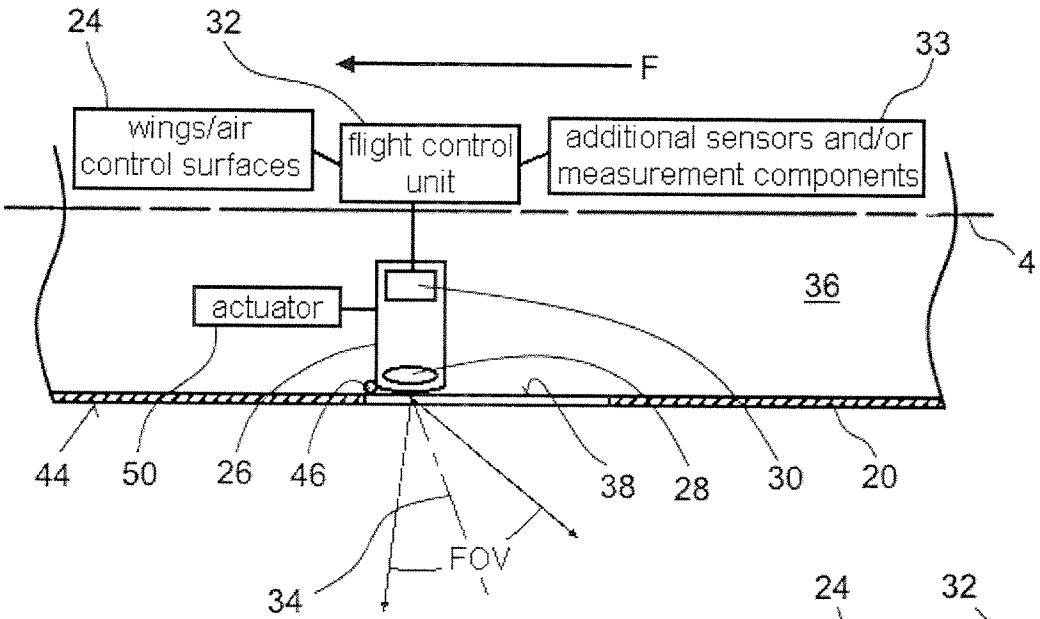
FIG. 4B is a diagrammatic cross-section of the guidance assembly according to FIG. 4A showing the imager/seeker in another navigation position.
Figure 6:
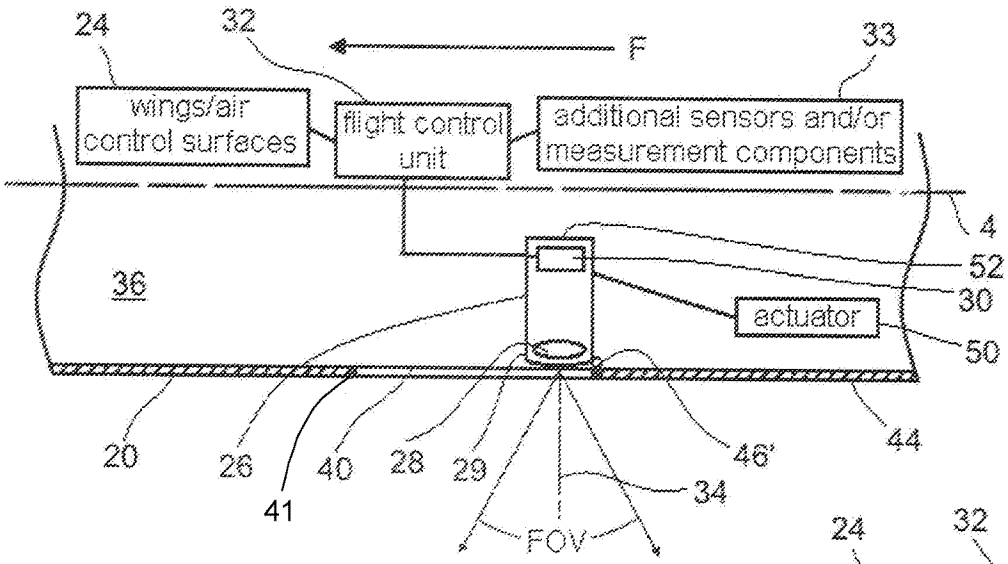
FIG. 6 is a diagrammatic cross-section of the mid-body showing a further embodiment of the guidance assembly with an imager/seeker in the navigation position.

As indicated above, the imager/seeker 26 functions in both the navigation and targeting modes of operation of the guidance assembly 22. Following the launch of the ordnance 2, the guidance assembly 22 operates in a navigation mode to guide the ordnance 2 in the general direction of the selected target. In this mode of operation, the ordnance is flown by the guidance assembly 22 like an airplane which, as noted above, necessitates knowing the attitude of the ordnance 2 relative to the earth. To facilitate determination of the up and down directions and the right and left directions of the ordnance along its direction of flight F relative to the earth, the imager/seeker 26 is positioned facing sideways as shown in FIGS. 4A, 4B and 6. In the sideways facing position, hereinafter referred to as the navigation position, the central axis 34 of the imager/seeker 26 is substantially perpendicular to the longitudinal axis 4 of the ordnance and the imager/seeker 26 is at least substantially contained within the interior 36 of the outer shell 20 of the mid-body 8. The head end 29 of the imager/seeker 26 faces radially outwards and either abuts or is closely adjacent to an inside surface 38 of a panel or rather window 40 that is transparent to the light energy. The panel or window 40 is formed to fit within and enclose an opening 42 in the mid-body 8 and be at least substantially flush with the exterior surface 44 of the outer shell 20 in a closed position as shown in FIGS. 2, 4A and 4B for example. In the navigation position, the entire imager/seeker 26 is located within the ordnance 2 behind the closed panel or window 40 such that the imager/seeker 26 is protected, e.g., sealed from environmental elements, such as dust, dirt, and rain, and from potential damage caused for example by personnel during handling and/or by other weapons in a cluster launch. For this purpose the perimeter of the opening 42 can be provided with a window seal 41 (see FIG. 6) which is arranged between the panel or window 40 and the outer shell 20. The panel or window 40 can be formed from a material that enables light energy or electromagnetic radiation to freely pass therethrough to the objective lens assembly 28.

It is to be appreciated that, in the navigation position, the imager/seeker 26 can be fixed within the interior 36 of the other shell 20 such that the central axis 34 is aligned at an obtuse angle relative to the longitudinal axis 4 in the direction of flight F. In other words, the central axis 34 is aligned in a rearward or backwards direction, i.e., opposite from the direction of flight F, as shown in FIG. 4B. With the imager/seeker 26 positioned such that the central axis 34 is angled rearward, the FOV can include the launch position. This is especially beneficial if the ordnance 2 is launched by a fire control system, located on or near the launch platform that transmits signals, e.g., pulse beacons, to the ordnance 2 which are captured by the imager/seeker 26 and enable the flight control unit 32 to track the attitude of the ordnance 2 and determine the pitch, roll and yaw of the ordnance 2 during flight. In one embodiment of the guidance assembly 22 according to the disclosure, the imager/seeker 26 comprises an LWIR imager which can receive signals from a LWIR transmitter of the fire control system that enable the flight control unit 32 to determine the attitude of the ordnance 2 as well as the heading of the ordnance 2 relative to the launch position. In another embodiment, the imager/seeker 26 comprises a SAL seeker which can receive signals of a pulse beacon on the launch platform to facilitate establishing the attitude of the ordnance 2 and with an altitude sensor and a magnetometer, as the additional sensors and/or measurement components 33, for determining the elevation of the ordnance 2 and the up direction.

During flight, the ordnance 2 transitions from the navigating phase of flight to the targeting phase of flight in which the guidance assembly 2 switches from the navigating mode of operation to the targeting mode of operation. During this switch, which will be discussed in further detail below, the imager/seeker 26 is moved from the navigation position to a generally forward facing position, i.e., a position in which the FOV is directed forward toward the longitudinal axis in relation to the direction of flight F. The forward facing position of the imager/seeker 26 is referred to hereinafter as its targeting position and is shown in FIGS. 5, 5A, 5B and 7. In the targeting position, the target is at least substantially located in the FOV of the imager/seeker 26 such that, based on the light energy captured by the objective lens assembly 28 and detected by the sensor array 30, the guidance assembly 22 is capable of identifying the selected target and precisely directing the ordnance to impact the target.

The transition from the vertical arrangement of the imager/seeker 26 in the navigation mode to the forward facing position of the imager/seeker 26 can also be a controlled transition. As the ordnance 2 approaches the target, a large FOV sensor, e.g., having a FOV of 45° is biased forward to 10° to 55° off the nadir. This allows for both navigation (pixels 10° off the nadir) and target search with the pixels at the 35° slant angle off the horizon. Once the target is identified and the terminal guidance is implemented by the guidance assembly 22, the ordnance 2 starts to pitch down, requiring the actuator 50 to rotate the sensor array 30 to the forward facing position, i.e., looking forward in the direction of flight F or directly at the target.

Figure 3:
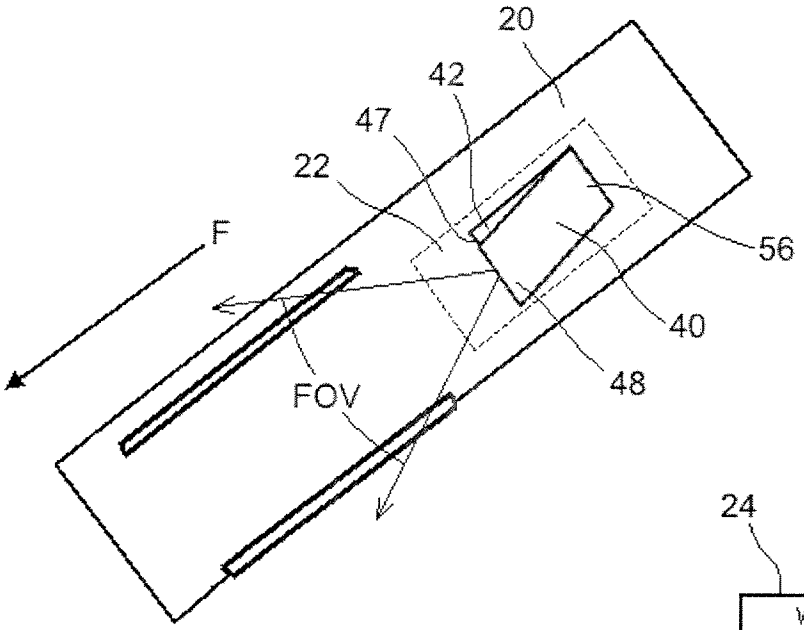
FIG. 3 is a diagrammatic view of the guidance assembly with the window panel shown in an open position.
Figure 5:
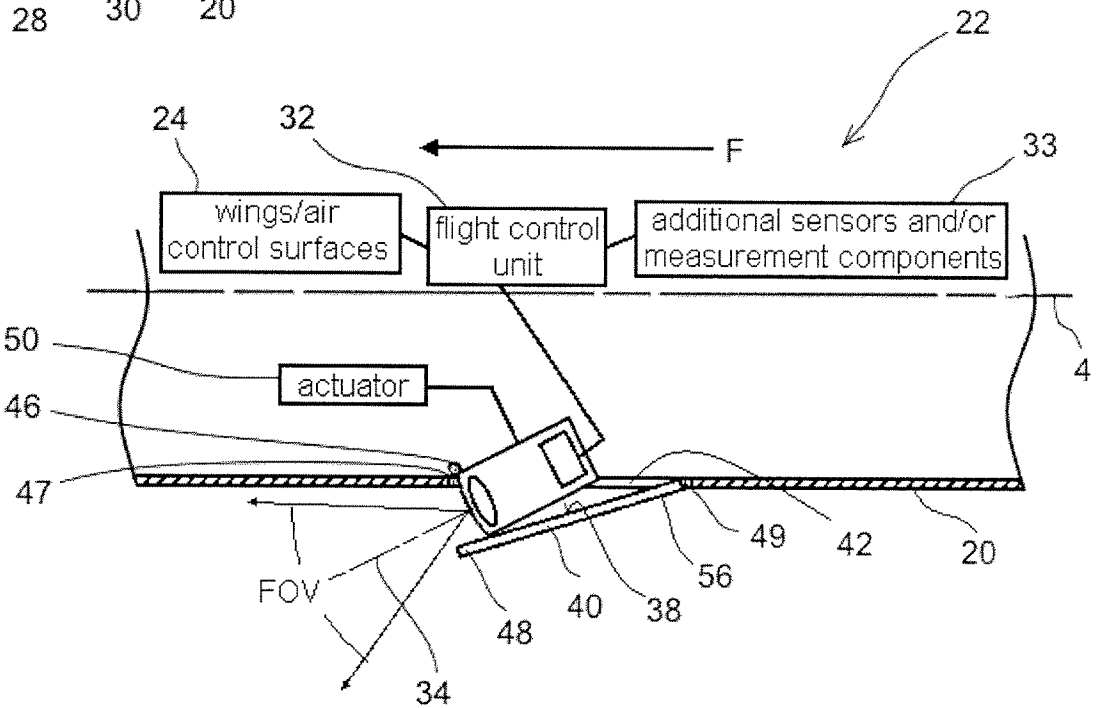
FIG. 5 is a diagrammatic cross-section of the mid-body showing the first embodiment of the guidance assembly with the imager/seeker in a targeting position.
Figure 5A:
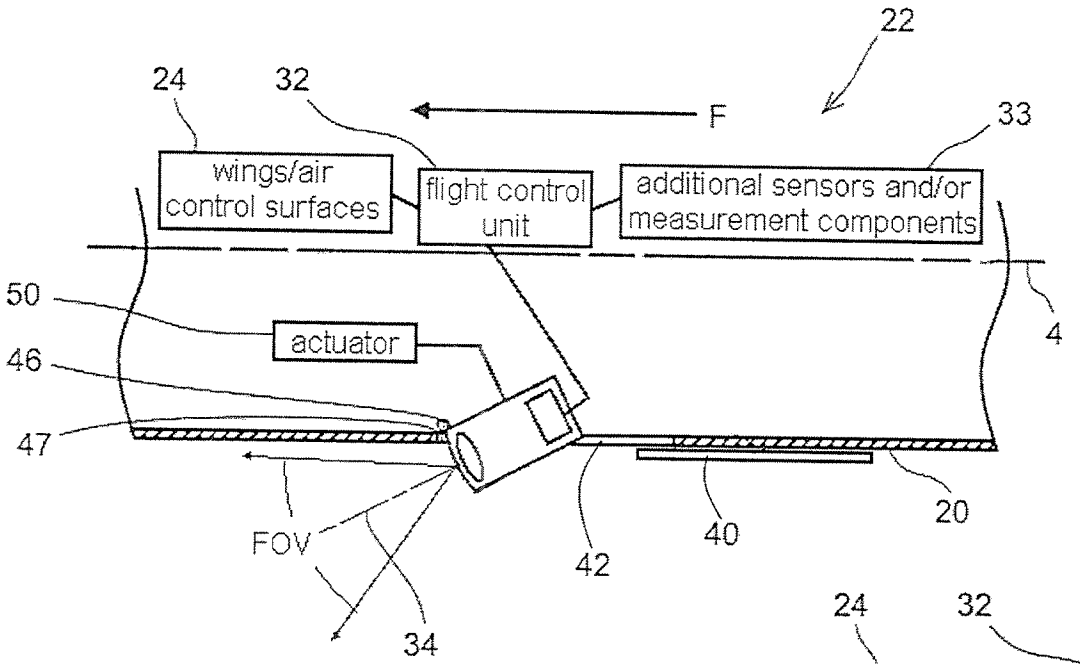
FIG. 5A is a diagrammatic cross-section of the mid-body showing the first embodiment of the guidance assembly with a sliding window.
Figure 5B:
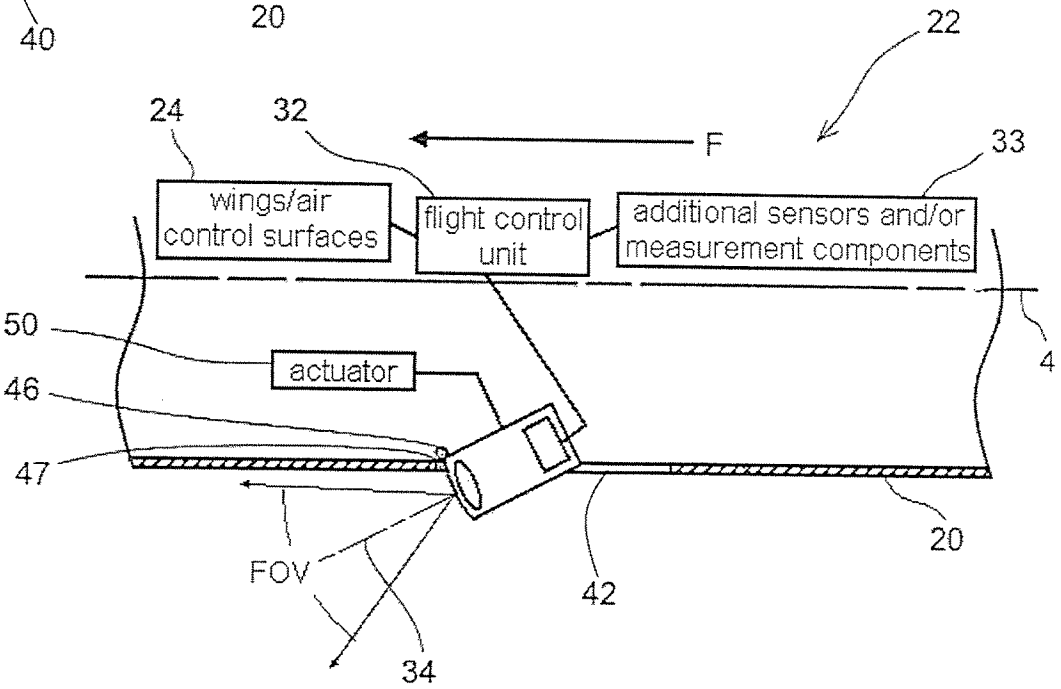
FIG. 5B is a diagrammatic cross-section of the mid-body showing the first embodiment of the guidance assembly with a blow away window.

In one embodiment of the guidance assembly 22 shown in FIGS. 4A, 4B, 5, 5A and 5B the head end 29 of the imager/seeker 26 is coupled to the outer shell 20 of the mid-body 8 by a hinge, pivot, spindle, or articulation 46 that is located at the leading end 47 of the opening 42. An actuator 50 is connected to the imager/seeker 26 at a distance away from the head end 29. The actuator 50 and articulation 46 can hold or retain the imager/seeker 26 in the navigation position during the navigation phase of flight of the ordnance 2, and can be activated by the flight control unit 32 to move the imager/seeker 36 to the targeting position for the targeting phase of flight. In the targeting position, the imager/seeker 36 is at least partially located on the exterior side of the outer shell 20. It is to be appreciated that the actuator 50 can be one or more of a MEMS actuator, a solenoid or an electromagnetic actuator which can be electrically actuated. The actuator 50 can also be a spring loaded actuator that biases the imager/seeker 26 by means of spring force such as for example when a latch holding the imager/seeker 26 is released. To move to the targeting position, a tail end 52 of the imager/seeker 26 is biased by the actuator 50 in a direction opposite to the direction of flight F, i.e., toward the trailing end of the ordnance 2. With the head end 29 of the imager/seeker 26 secured to the outer shell 20 at the leading end 47 of the opening 42, the imager/seeker 26 pivots such that the head end 29 protrudes through the opening 42 to the exterior side of the outer shell 20 and generally faces the forward direction, i.e., the direction of flight F. Specifically, in the targeting position of the imager/seeker 26, the central axis 34 thereof is aligned at an acute angle relative to the longitudinal axis 4 in the direction of flight F, i.e., the central axis 34 extends forward in the direction of flight F such that the entire FOV is aligned in the forward direction (see FIGS. 5, 5A, 5B for example). As illustrated, the imager/seeker 26 extends through the opening 42 in the outer shell 20 such that the head end 29 of the imager/seeker 26 is radially located outside the mid-body 8. To enable the head end of the imager/seeker 26 to pass through the opening 42, the panel or window 40 is pivoted to an open position such that the leading end 48 of the panel or window 40 is spaced away from the exterior surface 44 of the outer shell 20 as shown in FIGS. 1, 3 and 5 for example. In one embodiment the trailing end 56 of the panel or window 40 is fixed to the outer shell 20 by a pivot or articulation 49 (see FIG. 5). In a still further embodiment, the panel or window 40 can be a sliding window which retracts or slides along the surface of the outer shell 20 (see FIG. 5A). The sliding window 40 is beneficial in that the window 40 is retracted so as to lie on the outer shell 20 thereby at least minimizing any possible negative aerodynamic effects it may have on the ordnance 2 when deployed to the open position. In still another embodiment, the window 40 can be a simple "blow away" window which is ejected from or pushed out of the opening 42 when the imager/seeker 26 pivots and contacts the leading end 48 of the window 40. In this case the blow away window 40 simply falls away from the ordnance 2 when opened (see FIG. 5B). Such a blow away window 40 is beneficial in that the window 40 has no negative aerodynamic effects on the ordnance 2 and it requires minimal effort when securing or mounting the window 40 in the opening 42.

The panel or window 40 can be secured to the outer shell 20 such that when the imager/seeker 26 pivots to the targeting position, the panel or window 40 is simply pushed out of the opening 42 to fall away from the ordnance 2. In the targeting position of the imager/seeker 26, radially clear of the body of the ordnance 2, one edge of the FOV is aligned along the exterior surface 44 of the outer shell 20 and is substantially parallel toward or angled slightly toward the longitudinal axis 4. This provides the guidance assembly 22 with a vertical field of view in the direction of flight F which would include the target, for instance the entire FOV extends forward in the direction of flight F.

Figure 7:
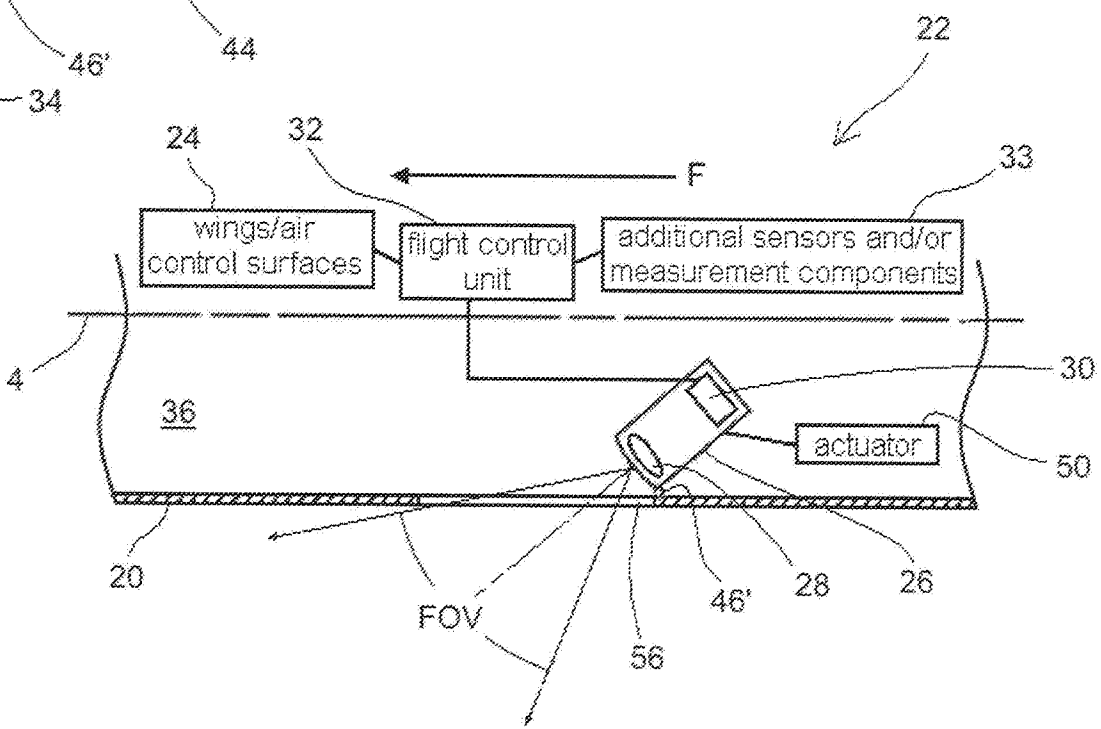
FIG. 7 is a diagrammatic cross-section of the mid-body showing the further embodiment of the guidance assembly with the imager/seeker in the targeting position.

In another embodiment of the guidance assembly 22 shown in FIGS. 6 and 7, the head end 29 of the imager/seeker 26 is coupled to the outer shell 20 of the mid-body 8 by the articulation 46 that is located at the trailing end 58 of the opening 42. As this embodiment of the guidance assembly is quite similar to the embodiment discussed above, only the differences will described below. With the head end 29 of the imager/seeker 26 secured to the outer shell 20 at the trailing end 56 of the panel or window 40, the imager/seeker 26 pivots such that the head end 29 generally faces the forward direction, but in this case remains entirely within the interior 36 of the outer shell 20. This configuration enables the transparent panel or window 40 to remain fixed in the opening 42 of the mid-body 8 and eliminates exposure of the imager/seeker 26 to the environment and aerodynamic influences on the ordnance 2 caused by extending the imager/seeker 26 into the airflow. In the targeting position of the imager/seeker 26 as shown in FIG. 7, the central axis 34 is aligned at an acute angle relative to the longitudinal axis 4 in the direction of flight F. Although this provides the guidance assembly 22 with a forward facing vertical FOV in the direction of flight F which would include the target, the FOV in the forward direction may be limited in comparison to that of the above described embodiment.

Figure 8:
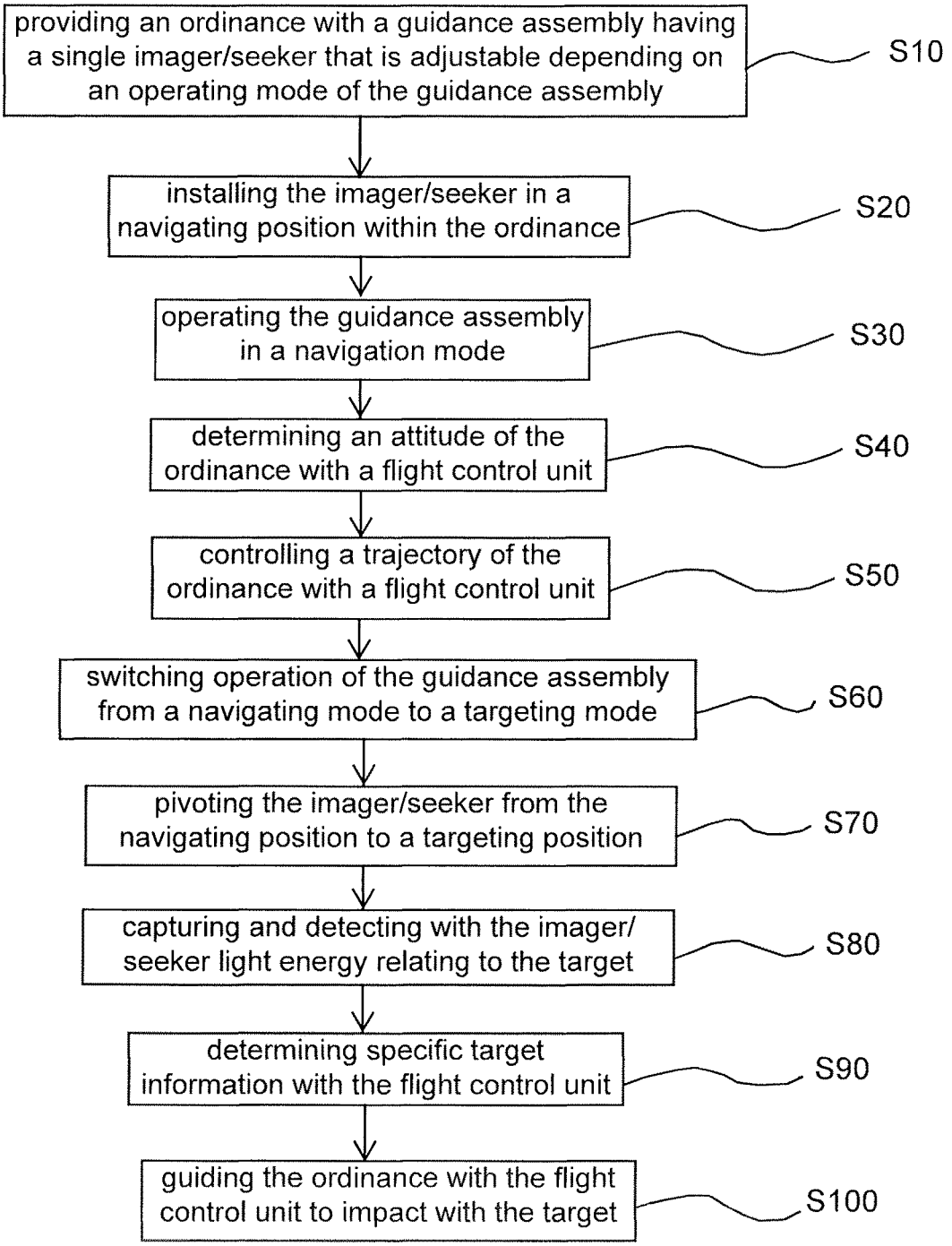
FIG. 8 is a flow diagram showing a method of guiding an ordnance with a guidance assembly operating in a navigation mode and a targeting mode.

FIG. 8 flow diagram that illustrates a method of guiding an ordnance 2 with a guidance assembly 22 according to the disclosure which is operates in the navigation mode and the targeting mode. Initially, the ordnance 2 is provided S10 with a guidance assembly 22 having a single imager/seeker 26 that can be realigned relative to the longitudinal axis 4 of the ordnance 2 depending on the operating mode of the guidance assembly 22. The imager/seeker 26 is installed S20 in a navigation position within the interior 36 of the ordnance 2 in which the center axis 34 of the imager/seeker 26 is at least substantially perpendicular to the longitudinal axis 4 of the ordnance 2. Following launch of the ordnance 2, i.e., during a navigation phase of the flight, the guidance assembly 22 operates S30 in the navigation mode such that the FOV of the imager/seeker 26 faces down in relation to the direction of flight F and in which the imager/seeker 26 captures and detects light energy. In the navigation operating mode of the guidance assembly 22, the flight control unit 32 determines S40 the attitude of the ordnance 2 from signals, which correspond to the light energy detected by the imager/seeker 26 and transmitted therefrom, as well as readings/data from one or more additional sensor and/or measurement components. Based on the determined attitude of the ordnance 2, the flight control unit 32 adjusts S50 alignment of the wings/air control surfaces 24 to control the trajectory of the ordnance and fly the ordnance like an airplane in the direction of the target. As the ordnance 2 approaches the target the guidance assembly 22 switched S60 from the navigation mode of operation to the targeting mode of operation.

The switch in the operating mode of the guidance assembly 22 can be initiated by the flight control unit 32 for example when it determines that the ordnance 2 is within a certain distance of the target or when it recognizes specific landmarks or terrain features located close to the target or even after a set duration of flight.

The transition from the vertical arrangement of the imager/seeker 26 in the navigation mode to the forward facing position of the imager/seeker 26 can also be a controlled transition. As the ordnance 2 approaches the target, a large FOV sensor, e.g., having a FOV of 45° is biased forward to 10° to 55° off the nadir. This allows for both navigation (pixels 10° off the nadir) and target search with the pixels at the 35° slant angle off the horizon. Once the target is identified and the terminal guidance is implemented by the guidance assembly 22, the ordnance 2 starts to pitch down, requiring the actuator 50 to rotate the sensor array 30 to the forward facing position, i.e., looking forward in the direction of flight F or directly at the target.

If the guidance assembly 22 is provided with the range to target, then the imager/seeker 26 could simply switch from the navigation mode to the targeting mode for terminal guidance of the ordnance based on the expected range or time of the flight to the target and an altitude and maneuverability of the ordnance 2 at a termination of the flight, or by detecting the target within the FOV of the imager/seeker 26, relying the IMU's ability to maintain a heading without adding significant drift during the transition.

Upon switching from the navigation to the targeting mode of operation, the flight control unit 32 actuates the actuator 50 causing the imager/seeker 26 to pivot S70 from the navigation position to a targeting position in which the center axis 34 of the imager/seeker 26 is at an acute angle in the direction of flight F relative to the longitudinal axis 4 of the ordnance 2. In the targeting position, during the targeting phase of flight, the imager/seeker 26 has a FOV that faces the forward direction, i.e., the direction of flight F and in which the imager/seeker 26 captures and detects S80 light energy relating to the target. With signals transmitted from the imager/seeker 26, which correspond to the light energy detected thereby, and with readings/data from one or more additional sensors and/or measurement components 33, the flight control unit 32 determines S90 specific readings and information concerning the target including the identity, location, and movement of the target such as for ATR purposes. Based on the determined specific readings and information concerning the target, the flight control unit 32 adjusts alignment of the wings/air control surfaces 24 to guide 5100 the ordnance 2 to impact with the target.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A guidance assembly being operable in a navigation mode and targeting mode for guiding an ordnance to a target, the guidance assembly comprising:

an imager/seeker having an objective lens assembly and an imaging sensor array which capture light energy and provide image data for the navigation and targeting modes of operation, the imager/seeker being pivotally mounted on a mid-body location of the ordnance;

an actuator being coupled to the imager/seeker and actuatable to pivot the imager/seeker relative to a longitudinal axis of the ordnance from a navigation position to a targeting position;

a flight control unit communicating with the imager/seeker, the flight control unit having a processor which analyses the image data and provides navigation flight control signals for guiding the ordnance in the navigation mode of operation and determines a target direction via automatic target recognition algorithms for directing the ordnance to the target in the targeting mode of operation;

wherein the flight control unit, during the navigation mode of operation, collects images from the imager/seeker while the imager/seeker is arranged in the navigation position, the flight control unit scales the collected images based on an altitude of the ordnance and de-warps the images, the flight control unit compares the collected images to a data base of images to determine ground position; and during a transition from the navigation mode of operation to the targeting mode of operation, the actuator pivots the imager/seeker to the targeting position based on a range of the flight or by detecting the target within the field of view of the imager/seeker.

2. The guidance assembly according to claim 1, wherein the imager/seeker being arranged in the navigation position during the navigation mode of operation and being pivoted, relative to the longitudinal axis, to the targeting position for the targeting mode of operation;

the imager/seeker having a field of view that, in the navigation position of the imager/seeker, is directed laterally relative to the longitudinal axis of the ordnance, and in the targeting position of the imager/seeker, the field of view is directed forward relative to a direction of flight of the ordnance.

3. The guidance assembly according to claim 1, wherein the imager/seeker having a field of view and a central axis, the central axis defining a center of the field of view, in the navigation position of the imager/seeker, the central axis of the imager/seeker extends either substantially perpendicular to the longitudinal axis or at an obtuse angle relative to the longitudinal axis in a direction of flight of the ordnance; and in the targeting position of the imager/seeker, the central axis of the imager/seeker extends at an acute angle relative to the longitudinal axis in the direction of flight of the ordnance.

4. The guidance assembly according to claim 3, wherein in the targeting position of the imager/seeker, the central axis of the imager/seeker extends forward in the direction of flight of the ordnance such that an entirety of the field of view of the imager/seeker extends forward in the direction of flight of the ordnance.

5. The guidance assembly according to claim 1, wherein the imager/seeker is mounted on the ordnance by an articulation such that, in the navigation position, the imager/seeker is entirely located within an interior of the ordnance, and, in the targeting position, at least a portion of the imager/seeker extends through an opening in the ordnance to an exterior of the ordnance.

6. The guidance assembly according to claim 5, wherein the articulation being arranged at a leading end of the opening relative to the direction of flight; and a window being mounted on the ordnance enclosing the opening when the imager/seeker is arranged in the navigation position, and at least a leading end of the window being biased out of the opening away from the longitudinal axis when the imager/seeker is arranged in the targeting position.

7. The guidance assembly according to claim 1, wherein the flight control unit communicating with an inertial measuring unit during the navigation mode of operation to determine an attitude of the ordnance based on the image data of the imager/seeker and measurements of the inertial measuring unit.

8. The guidance assembly according to claim 2, wherein the ordnance comprises an opening in which a window is mounted, the window being transparent to the light energy, the imager/seeker is mounted to the ordnance by an articulation such that, in both the navigation and the targeting positions, the imager/seeker is located within an interior of the ordnance.

9. The guidance assembly according to claim 8, wherein the articulation couples the imager/seeker at a trailing end of the window relative to the direction of flight of the ordnance, and the imager/seeker is located entirely within the interior of the ordnance in both the navigation and the targeting positions.

10. The guidance assembly according to claim 1, wherein the imager/seeker is supported within the ordnance and the objective lens assembly comprises a window that is mounted to an outer surface of the ordnance, the window being sealed to the outer surface of the ordnance by a window seal to protect the imager/seeker from an exterior of the ordnance.

11. The guidance assembly according to claim 1, further comprising a global positioning system, an inertial measuring unit, and a laser range finder which collect at least one of mapping, navigation, motion, force, range and distance readings/data which are processed by the processor to facilitate guiding the ordnance in the navigation mode of operation and determining the target direction and directing the ordnance to the target in the targeting mode of operation.

12. A method of guiding an ordnance with a guidance assembly that operates in a navigation mode and a targeting mode, the method comprising:

providing on the mid-body of the ordnance a guidance assembly having a single imager/seeker that is pivotable depending on an operating mode of the guidance assembly;

installing the imager/seeker in a navigation position within the ordnance;

operating the guidance assembly in the navigation mode;

determining, with a flight control unit, an attitude of the ordnance;

controlling, with the flight control unit, a trajectory of the ordnance;

switching operation of the guidance assembly from the navigation mode of operation to the targeting mode of operation;

pivoting the imager/seeker from the navigation position to a targeting position;

capturing and detecting light energy relating to the target with the imager/seeker;

determining specific target information with the flight control unit; and guiding the ordnance with the flight control unit to impact with the target;

wherein the flight control unit, during the navigation mode of operation, collects images from the imager/seeker while the imager/seeker is arranged in the navigation position, the flight control unit scales the collected images based on an altitude of the ordnance and de-warps the images, the flight control unit compares the collected images to a data base of images to determine ground position; and during a transition from the navigation mode of operation to the targeting mode of operation, the actuator pivots the imager/seeker to the targeting position based on a range of the flight or by detecting the target within the field of view of the imager/seeker.

13. The method according to claim 12, further comprising installing the imager/seeker in the navigation position in which a center axis of the imager/seeker is at least substantially perpendicular to a longitudinal axis of the ordnance; and pivoting the imager/seeker from the navigation position to the targeting position in which the center axis of the imager/seeker is at an acute angle in a direction of flight relative to the longitudinal axis of the ordnance.

14. The method according to claim 13, further comprising installing the imager/seeker in the navigation position in which the imager/seeker is arranged during the navigation operating mode of the guidance assembly; and pivoting the imager/seeker from the navigation position to the targeting position based on a trajectory of the ordnance, knowledge of a range or duration of time to the target, and an altitude and maneuverability of the ordnance at a termination of the flight.

* * * * *